US006431606B1

(12) United States Patent
Lowe et al.

(10) Patent No.: US 6,431,606 B1
(45) Date of Patent: Aug. 13, 2002

(54) MEMORY ALBUM

(76) Inventors: Kent D. Lowe; Janis L. Lowe, both of 12629 Ridgewood Rd., Jefferson, OR (US) 97352

( * ) Notice: Subject to any disclaimer, the term of this patent is extended or adjusted under 35 U.S.C. 154(b) by 0 days.

(21) Appl. No.: 09/771,359

(22) Filed: Jan. 26, 2001

(51) Int. Cl.[7] ..... B42D 1/00

(52) U.S. Cl. ..... 281/38; 40/124.01; 40/124.14; 281/31; 281/22; 434/317; 446/147

(58) Field of Search ..... 40/124.01, 124.13, 40/124.14; 281/2, 5, 3.1, 15.1, 22, 29, 36–38; 283/34, 63.1, 64, 61, 62; 434/317; 446/147, 148, 150

(56) References Cited

U.S. PATENT DOCUMENTS

| | | | | |
|---|---|---|---|---|
| 1,512,598 | A | * 10/1924 | Harriman | |
| 3,189,369 | A | * 6/1965 | Walker, Jr. | |
| 3,738,686 | A | * 6/1973 | Morse | 283/63 |
| 4,289,333 | A | * 9/1981 | Gaetano | 283/35 |
| 4,627,640 | A | * 12/1986 | Markovics | 281/5 |
| 4,964,643 | A | * 10/1990 | Hass | 273/285 |
| 5,018,764 | A | * 5/1991 | Beardell | 281/15.1 |
| 5,156,898 | A | * 10/1992 | McDonald | 428/100 |
| 5,232,371 | A | * 8/1993 | Day-Cain | 281/15.1 |
| 5,466,009 | A | * 11/1995 | Brown | 283/34 |
| 6,209,919 | B1 | * 4/2001 | Nilsson et al. | 283/61 |

FOREIGN PATENT DOCUMENTS

| | | |
|---|---|---|
| GB | 2222802 | * 3/1990 |
| GB | 2300597 | * 11/1996 |

* cited by examiner

*Primary Examiner*—A. L. Wellington
*Assistant Examiner*—Monica S. Carter
(74) *Attorney, Agent, or Firm*—Timothy J. Martin; Michael R. Henson; Mark H. Weygandt

(57) ABSTRACT

A memory album retains and displays items of memorabilia and comprises top and bottom covers, which may be constructed of a stiff backing material and have a selected geometric configuration, and a foldable display panel disposed between the covers for receiving the items of memorabilia. The foldable display panel is moveable between a compact state where it is in a collapsed configuration with the top and bottom covers positioned in a first orientation with respect to one another, and an expanded state where it is in a flattened configuration with the top and bottom covers positioned at a second orientation with respect to one another. The display panel is operative upon movement of the memory album between the compact state and the expanded state to extend along both a first direction that is parallel to longitudinal axis and a second direction that is transverse thereto, thereby to reveal a plurality of display panel regions adapted to receivably retain the items of memorabilia.

31 Claims, 5 Drawing Sheets

MEMORY ALBUM

FIELD OF THE INVENTION

The present invention relates generally to the collection of memorabilia. More particularly, the present invention concerns the collection and retention of memorabilia items in a manner which provides convenient storage, accessibility and versatile display thereof by the collector. More specifically, the present invention concerns a collectable item in the form of a memory album for retaining and displaying items of memorabilia.

BACKGROUND OF THE INVENTION

The collection and preservation of various types of items is a past-time for many individuals. For some, objects are collected for their monetary value and may be retained as part of a collection of related items in the hope that they appreciate in value, until such time when they can be sold by the collector for profit. Items of this nature might include, for example, artwork, coins, jewelry, books or antiques. Avid collectors of such items may frequent auctions, tradeshows, flea markets or even garage sales in the hope of acquiring a collectable object for less than its actual value. Many organizations such as museums also collect and distribute items in their galleries including fine paintings, sculptures and other artifacts to display as exhibits for the enjoyment and education of the public.

For others, collecting objects is a hobby where the items generally serve as a source of pride, happiness, or entertainment. While the items themselves may have extraordinary monetary value, the sentimental value of the collectable may far outweigh its monetary value in the eye of the beholder. Such memorabilia may encompass a variety of items such as photographs, newspaper articles, concert tickets, preserved flowers, letters, etc. By their very nature, these types of memorabilia remind people of events which have transpired during their lifetimes.

While some choose to store their items of memorabilia in boxes or closets, others are more organized and preserve them in photo albums and scrapbooks so that they can be conveniently accessed and perused as desired. Scrapbooks themselves are available in a variety of different designs which may vary in size, shape and color. Regardless of these variations, scrapbooks generally have front and back covers joined by a spine with a plurality of pages for receiving the items of memorabilia. In essence, the construction of scrapbooks dictates the way in which the memorabilia is presented. Pictures and other memorabilia must necessarily be accommodated within the confines of the size and shape of the individual pages, and the memorabilia generally lays flat on each page. When leafing through a scrapbook, the memorabilia items displayed at any given time are generally limited to those present on adjacent pages of the scrapbook. As such, the view area at any given instant is somewhat limited and the pages tend to disrupt the continuity of the arrangement. This is particularly true if one's scrapbook is intended to convey a progression in time, such as the growth and development of a newborn baby. A complete mosaic illustrating this progression necessarily cannot be conveyed in one viewing by the very nature of the scrapbook construction.

Accordingly, there remains a need to provide a new design and construction for a memory album, such as a scrapbook, which is versatile in construction while allowing one to view the contents thereof in their entirety without having to consecutively leaf through a plurality of pages in order to appreciate the overall story or theme displayed therein. There is a further need to provide a scrapbook which is both compact and decorative in its construction so that it is both functional and visually appealing. The present invention is particularly directed to meeting these needs.

SUMMARY OF THE INVENTION

It is an object of the present invention to provide a new and useful memory album which is adapted to retain and display items of memorabilia, such as photographs, newspaper clippings, writings, ticket stubs, and other like small items.

It is another object of the present invention to provide such a memory album which may be stored in a compact state, yet opened up into an expanded state thereby to display the items of memorabilia.

A further object of the present invention is to provide a new and useful memory album which is versatile in construction while allowing one to view the contents thereof in their entirety without having to consecutively leaf through a plurality of pages.

Yet another object of the present invention is to provide a memory album, preferably in the form of a scrapbook, which is both compact and decorative in its construction so that is functional and visually appealing.

In accordance with these objectives, the present invention provides for a memory album that is adapted for use in retaining and displaying items of memorabilia. Broadly, the memory album comprises a top cover, a bottom cover and a foldable display panel disposed between the top and bottom covers for receiving the items of memorabilia. The memory album is movable between a compact state wherein the display panel is in a collapsed configuration with the top and bottom covers positioned in a first orientation with respect to one another, and an expanded state wherein the display panel is in a flattened configuration extending along a longitudinal axis with the top and bottom covers positioned at a second orientation with respect to one another that is different than the first orientation.

The display panel is operative upon movement of the memory album between the compact state and the expanded state to extend along both a first direction that is parallel to a longitudinal axis of the display panel and a second direction that is transverse to the longitudinal axis of the display panel, thereby to reveal a plurality of display panel regions that are adapted to receivably retain the items of memorabilia. Also, in the first exemplary embodiment, the display panel unfolds along a plurality of fold lines that each extend transversely to the longitudinal axis when the display panel is in the flattened configuration.

Each of the top and bottom covers preferably measures 4.25"×4.25". Although not required, they are also preferably detached from one another and constructed of a stiff backing material, such as cardboard, with the foldable display panel interconnected therebetween. The display panel regions of the display panel preferably measure 4"×4" so that they are geometrically similar, but smaller, than the top and bottom covers.

In a first exemplary embodiment of the memory album the top and bottom covers are positioned in a close, spaced-apart relationship to one another when the memory album is in the compact state and they are positioned along the longitudinal axis a selected separation distance from one another when the memory album is in the expanded state. Also in this first exemplary embodiment, first ones of the fold lines extend perpendicularly to the longitudinal axis of the display panel, while second and third ones of the fold lines extend at an acute angle with respect to the longitudinal axis. More particularly, the second fold lines extend at a positive acute angle with respect to the longitudinal axis, while the third fold lines extend at a negative acute angle with respect to the longitudinal axis. Associated ones of the first, second and third fold lines intersect at a common point along the longitudinal axis, and each of the second and third fold lines has a common length and intersects the longitudinal axis at a common acute angle. Further, longitudinally adjacent ones of the second and third fold lines share a common end point thereby to define a plurality of longitudinally adjacent and geometrically congruent display panel regions sharing a common vertex defined by a respective common point. Longitudinally opposed end ones of these display panel regions are secured, respectively, to the top and bottom covers. Each of the first fold lines preferably has a common second length thereby to define a plurality of transversely spaced-apart and geometrically congruent pairs of display panel regions. These transversely spaced-apart pairs of display panel regions are bisected by an associated one of the first fold lines into geometrically congruent sub-regions.

In the second exemplary embodiment of the present invention, the top and bottom covers are also positioned in a close spaced-apart relationship to one another when in the compact state, but are positioned in a side-by-side relationship to one another when the memory album is in the expanded state. In each of the first and second exemplary embodiments, it is preferred that the top and bottom covers have a common geometric shape, such as rectangular, and that each of the display panel regions be configured geometrically similar to these covers. It is also preferred that a fastening member be connected to a selected one of the top and bottom covers, with this fastening member operative when placed in fastened configuration to prevent the memory album from moving from the compact state to the expanded state. The fastening member is preferably an elongated and flexible band having a mid-portion bonded to the bottom cover and a pair of opposed free ends which are adapted to encircle the top cover and tie together, thereby placing the fastening member in the fastened configuration.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention relates to a memory album which is adapted for use in retaining and displaying items of memorabilia. In the description to follow relating to the exemplary embodiments, the memory album of the present invention is generally in the form of a scrapbook which can be stored in a compact state and opened up into an expanded state to display the items of memorabilia.

Figure 1:
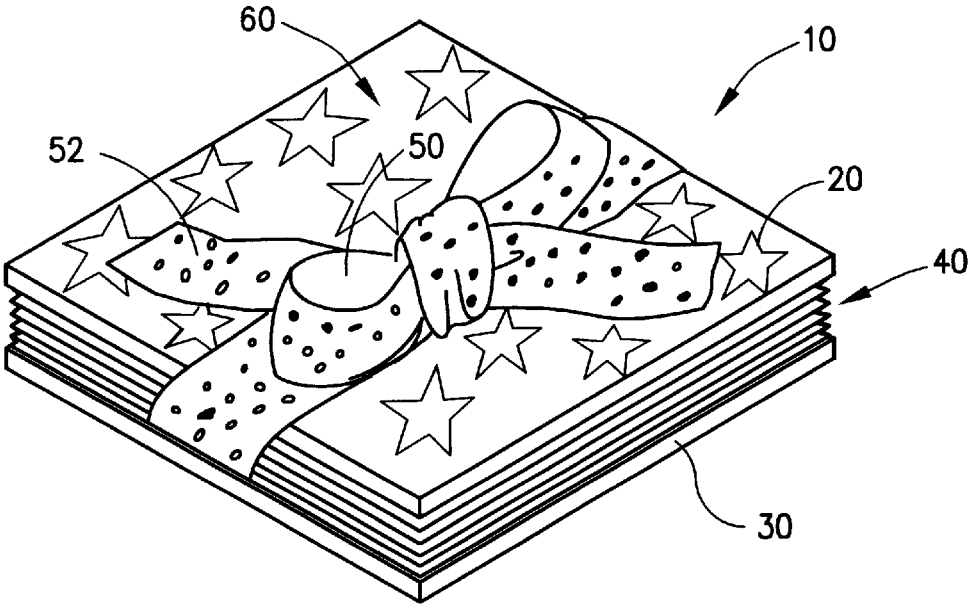
FIG. 1 is a perspective view of the memory album according to a first exemplary embodiment of the present invention, and specifically showing the memory album in its compact state.

A first exemplary embodiment of the memory album 10 of the present invention is shown in FIGS. 1–6. With initial reference to FIG. 1, memory album 10 is shown in its compact state. Memory album 10 broadly includes a top cover 20, a bottom cover 30 and a foldable display panel 40 disposed therebetween. A fastening member 50 is operative when placed in a fastened configuration as shown in FIG. 1 to retain memory album 10 in the compact state. In the exemplary embodiments of the present invention, fastening member 50 is shown to be in the form of an elongated flexible band, such as a decorative ribbon, having opposed free ends 52 and 54 which can be tied together in an appropriate manner to create the fastened configuration which is shown in FIG. 1 to be a bow tie. Printed indicia 60 may also be provided on both top cover 20 and bottom cover 30 to enhance the decorative appearance of memory album 10.

Figure 3:
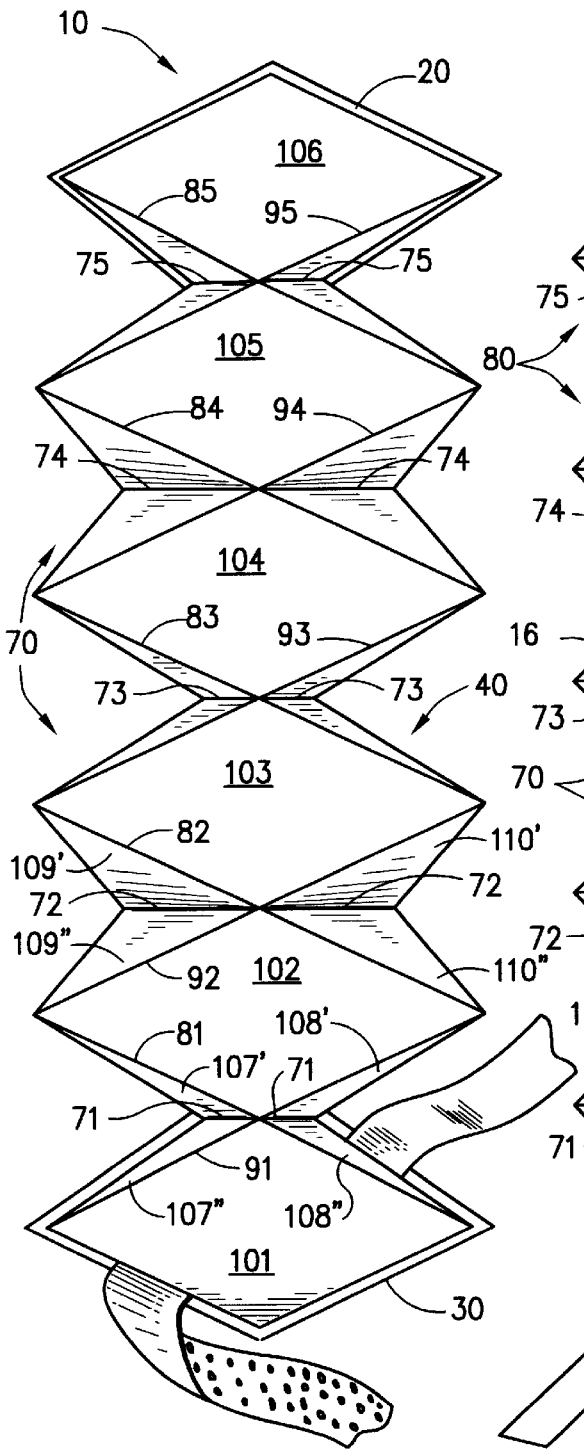
FIG. 3 is a perspective view of the memory album in a second intermediate position as it approaches the fully expanded state.
Figure 4:
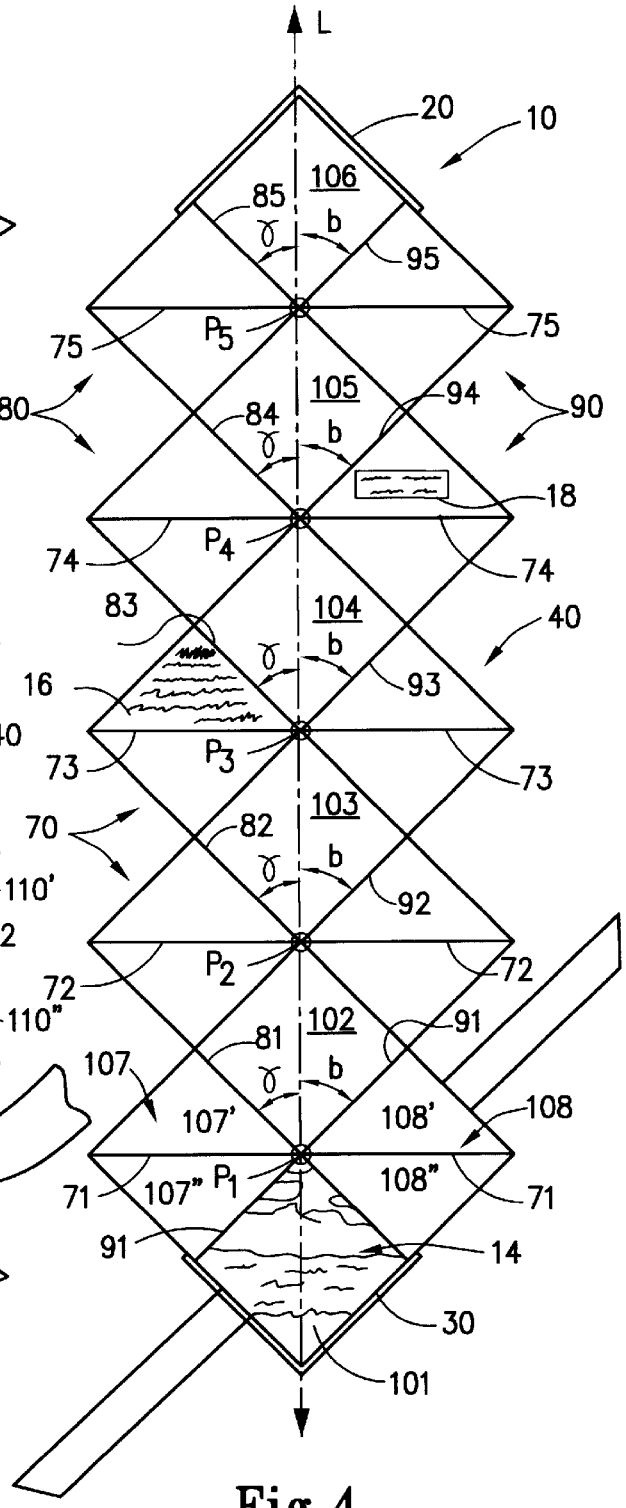
FIG. 4 is a top planer view the memory album in the fully expanded state.

As stated above, memory album 10 is movable between the compact state shown in FIG. 1 and a fully expanded state as shown in FIG. 4. For illustrative purposes, intermediate states may also be appreciated with reference to FIGS. 2 and 3. In the compact state of FIG. 1, display panel 40 is in a collapsed configuration, while the top and bottom covers 20, 30 are positioned in a first orientation with respect to one another such that they are in close spaced-apart relationship. When in the fully expanded state shown in FIG. 4, display panel 40 is fully extended in a flattened configuration along a longitudinal axis "L", while top and bottom covers 20, 30 are positioned in a second orientation such that there is a longitudinal separation distance between them.

Figure 2:
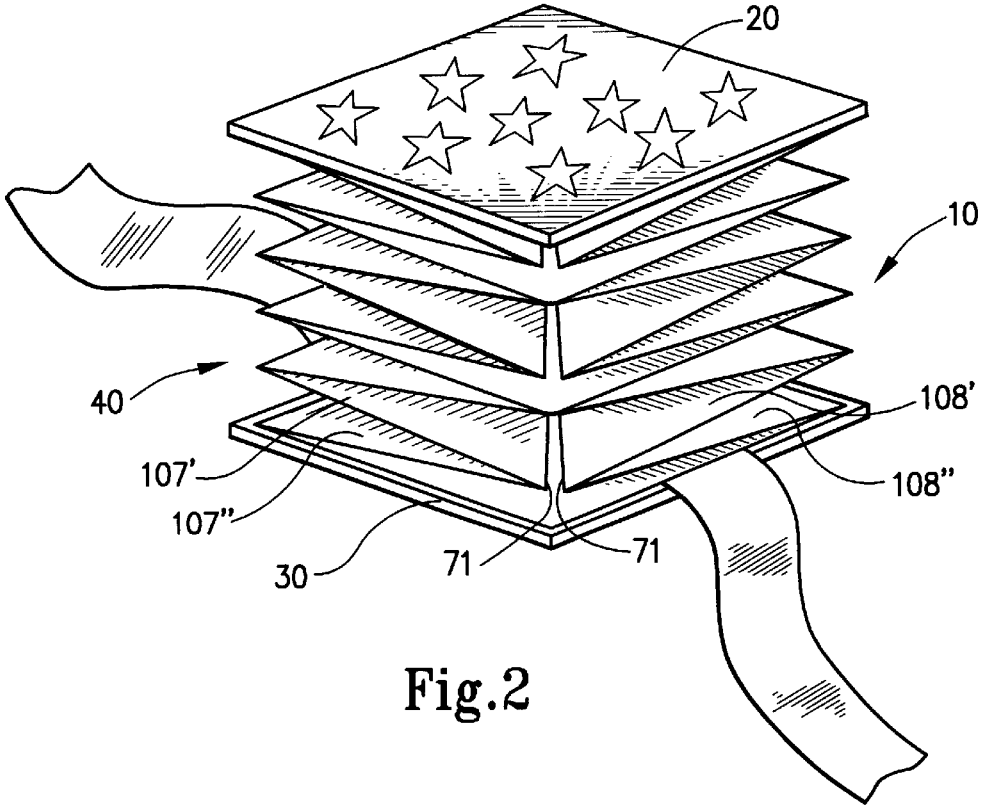
FIG. 2 is a perspective view of the memory album in a first intermediate position as it begins to move from the compact state of FIG. 1 to a fully expanded state.

As best shown in FIGS. 2–4, display panel 40 is particularly operative upon movement of the memory album 10 between the compact state and the fully expanded state to unfold in an accordion-like manner about a plurality of fold lines extending transversely to the longitudinal axis "L" of the display panel 40 when the display panel is in the flattened configuration, thereby to reveal a plurality of display panel regions that are adapted to receivably retain items of memorabilia 12. For illustrative purposes only, these various items of memorabilia 12 might include, for example, a photograph 14, a writing 16, a ticket stub 18, or the like. While only a select few representative items of memorabilia are shown in FIG. 4, it should be readily appreciated that other items of memorabilia of like nature may be appropriately bonded to the various display regions of display panel 40, as desired, to create an overall visual mosaic or theme for memory album 10. To this end, display panel 40 may be construction paper, or other suitable material, which can fold and have memorabilia items affixed thereto via an adhesive or other conventional mounting means.

The various fold lines associated with memory album 10 may best be seen with reference to FIGS. 3 and 4. First ones 70 of these fold lines include fold lines 71–75 which extend perpendicularly to longitudinal axis "L". Second ones 80 of these fold lines include fold lines 81–85 which each extend at a positive acute angle "α" with respect to longitudinal axis "L" when display panel is in the flattened configuration (FIG. 4). Third ones 90 of these fold lines 91–95 extend at a negative acute angle "β" with respect to longitudinal axis "L" (FIG. 4). For purposes of the description herein, the term "fold" specifically contemplates a structure which creases or bends as shown in the figures but is additionally meant to encompass pieces that are hinged together, such as by tape, glue or otherwise.

Associated ones of the first, second and third fold lines 70, 80 and 90, respectively, intersect at a common point along longitudinal axis "L", as also best shown in FIG. 4. For example, associated ones of the first, second and third fold lines 71, 81 and 91, respectively, intersect at a common point "$P_1$" along longitudinal axis "L". Similarly, associated fold lines 72, 82 and 92 intersect longitudinal axis "L" at a common point "$P_2$", and so on. Points $P_1$–$P_5$ are actually formed as notches to facilitate folding of display panel 40.

In this first exemplary embodiment of the memory album 10 of the present invention, certain geometric relationships exist between the various fold lines 70, 80 and 90, display panel 40, top cover 20 and bottom cover 30. That is, second fold lines 81–85 and third fold lines 91–95 have a common length and intersect the longitudinal axis at a common acute angle, such that angles "α" and "β" are complimentary angles. Further, it may be seen that longitudinally adjacent pairs of these second and third fold lines 81, 93; 82, 94; 83, 95; 91, 83; 92, 84; and 93, 85 share common end points. As such, a plurality of longitudinally adjacent and geometrically congruent display panel regions 101–106 are formed as diamond-shaped regions which share a common vertex defined by a respective one of points $P_1$–$P_5$. These regions 101–106 are geometrically similar to top and bottom covers 20, 30 so that they are also square-shaped. End ones 101 and 106 of these display panel regions are secured, respectively, to bottom cover 30 and top cover 20.

Each of first fold lines 71–75 extends perpendicularly to longitudinal axis "L" and are also of a common length. Each of first fold lines 71–75, thus, bisects associated display panel regions into geometrically congruent sub-regions. For example, first fold line 71 bisects display panel region 107 into sub-regions 107' and 107Δ and bisects display panel 108 into sub-regions 108' and 108Δ. Each of these sub-regions is triangular in configuration. These triangularly configured sub-regions, such as 107' and 107", provide for the capability of displaying images of reduced size on display panel 40 as compared to images which can be presented on display panel regions 101–106.

Now that the various geometric characteristics of memory album 10 have been described, the folding aspects of the memory album 10 can be better appreciated with particular reference to the intermediate states shown in FIGS. 2 and 3. As memory album 10 begins to move from the compact state to the fully expanded state, the various display panel sub-regions form hinged wings which spread apart about their associated fold lines. For example, it may be seen representatively in FIGS. 2 and 3 that sub-regions 107' and 107" flare about their associated first fold line 71 as the display panel 40 moves from the collapsed configuration to the flattened configuration, as do sub-regions 108' and 108". The same holds true for the remaining display panel sub-regions which form component parts of foldable display panel 40. As may be best appreciated with reference to FIG. 3, longitudinally adjacent ones of first fold lines 71–75 are creased such that their associated display panel sub-regions are reverse folded. That is, first fold line 71 would appear to project out of the page in FIG. 3, as would first fold lines 73 and 75, while first fold lines 72 and 74 would appear to project away from the plane defined by FIG. 3 in a rearward direction.

Figure 5:
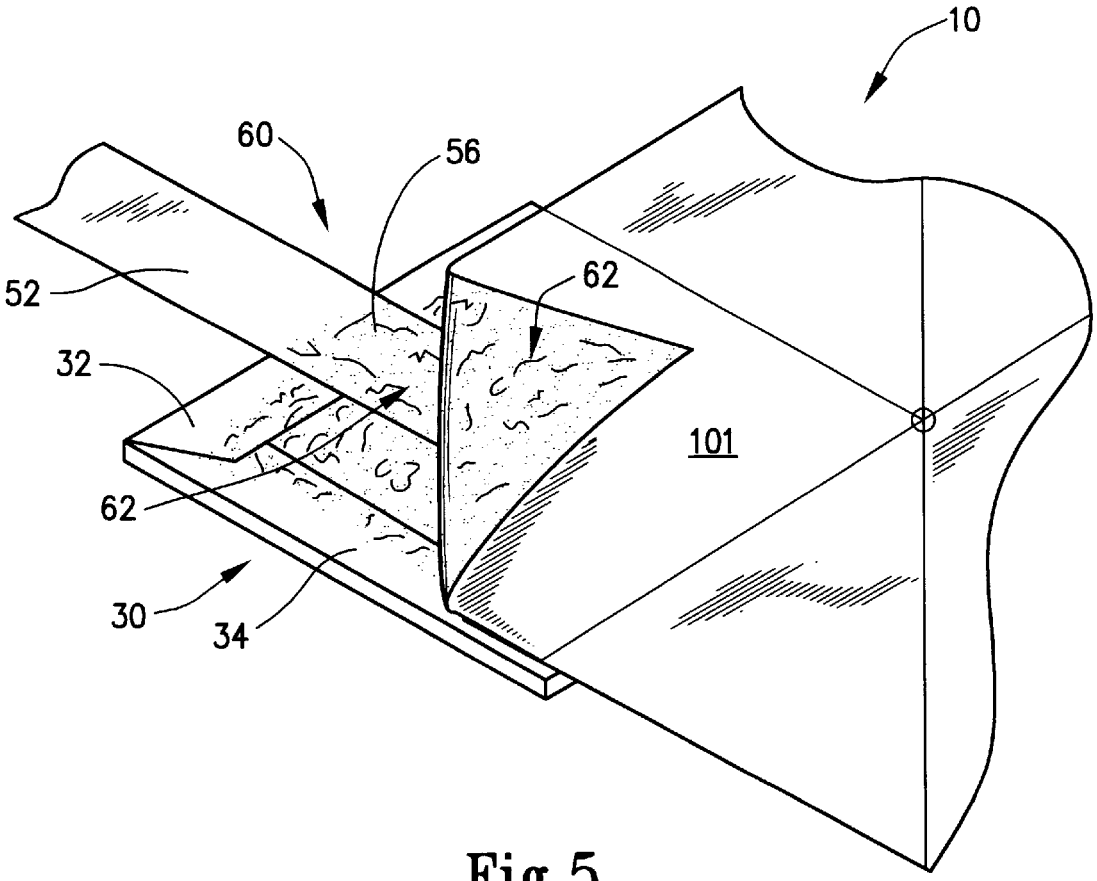
FIG. 5 is a perspective view of a portion of the memory album, and specifically showing a longitudinal end one of its display panel regions partially peeled back to reveal the construction of the bottom cover and fastening member thereof.
Figure 6:
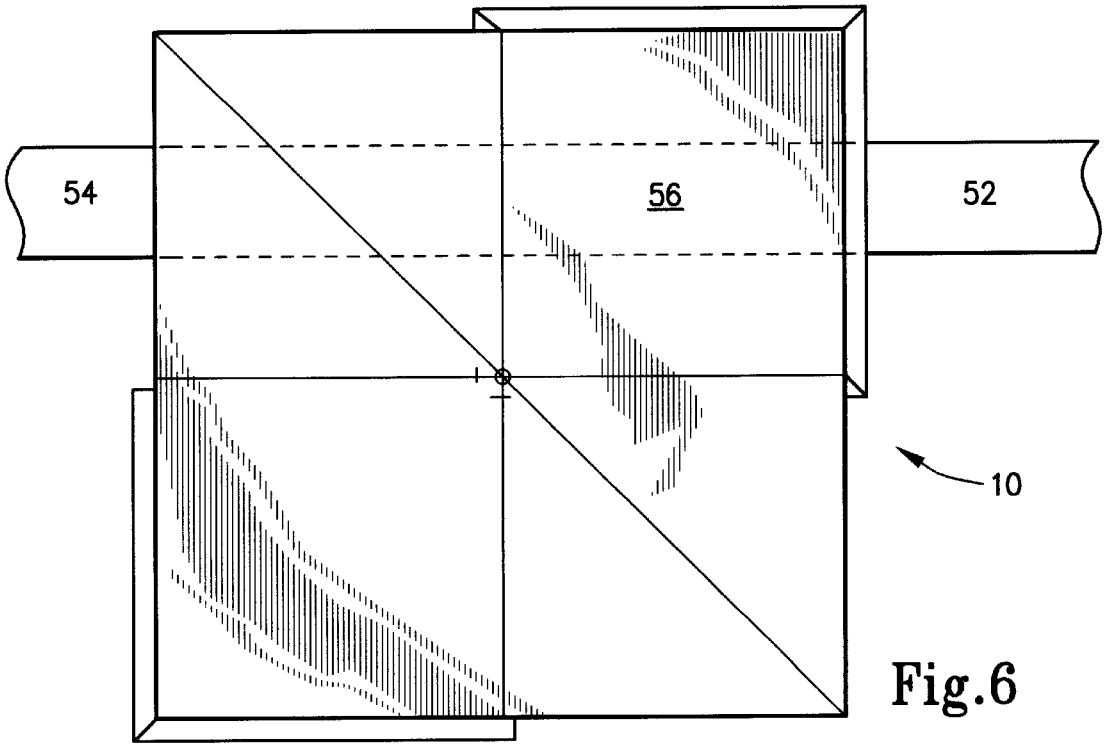
FIG. 6 is a top planer view of the memory album in a partly open position.

Having now described some of the various construction aspects of the memory album 10 of the present invention, other characteristics may be appreciated with reference to FIGS. 5 and 6. As discussed above, memory album 10 also preferably includes an appropriate fastening member, such as an elongated and flexible ribbon tie 50 which operates when placed in a fastened configuration to prevent memory album 10 from moving from the compact state to the expanded state. Fastening member 50 preferably has a mid-portion 56 thereof bonded between bottom cover 30 and square-shaped display panel region 101 by an appropriate adhesive layer 62. Adhesive layer 62 is, in fact, disposed on the entire lower surface of display panel region 101 and serves both to adhere display panel region 101 to bottom cover 30 and bond the mid-portion 56 of fastening member 50 therebetween. Although not shown, a similar adhesive likewise bonds a lower surface of display region 106 to top cover 20. In any event, when memory album 10 is placed in the compact configuration, the opposed free ends 52 and 54 of fastening member 50 can be appropriately tied together to retain memory album 10 in the compact configuration shown in FIG. 1. Of course, the ordinarily skilled artisan should readily appreciate that other types of fastening members can be utilized to retain the memory album 10 in the compact state. For example, other types of fastening structures might include cooperative snaps, cooperative hook and loop fasteners, etc. Thus, the present invention should not be unnecessarily limited to the particular type of fastening member shown in the exemplary embodiments.

Each of the top and bottom covers 20, 30 is preferably constructed of a stiff backing material, such as cardboard. A layer of wrapping, such as wrapping 32 associated with top cover 30, may also be provided for each of the top and bottom covers 20, 30 and inwardly folded about the surrounding edge margins thereof. This layer of wrapping material is provided with the printed indicia 60 shown in FIG. 1 to create an esthetically pleasing and appealing look to memory album 10.

Figure 7:
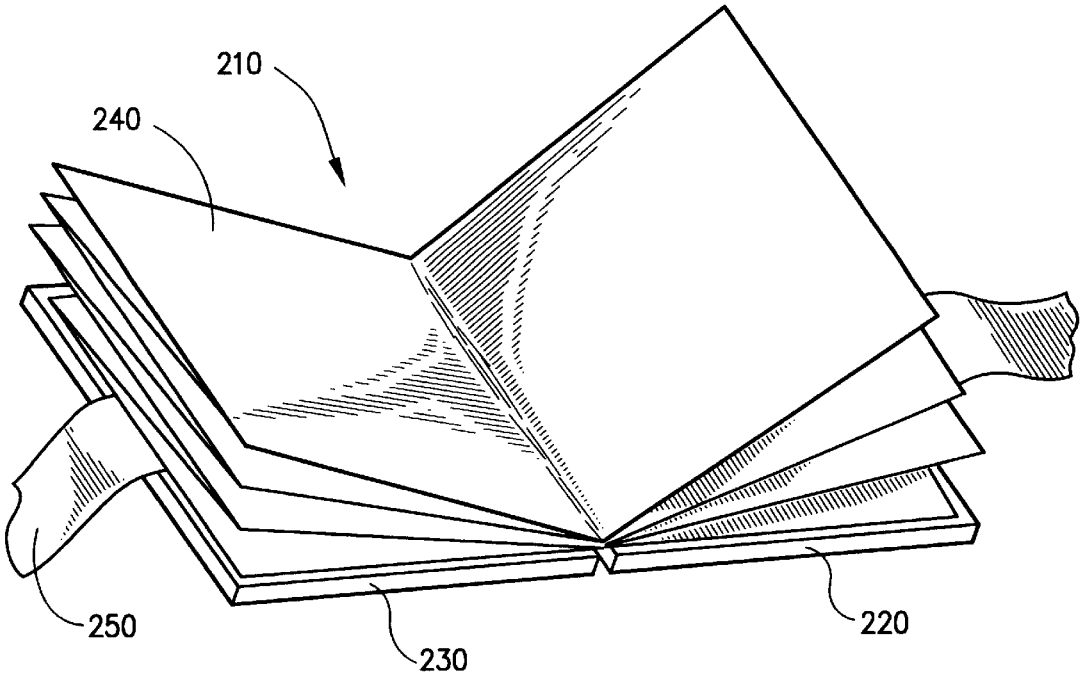
FIG. 7 is a perspective view of a second exemplary embodiment of the memory album of the present invention, and specifically showing it unfolded into an intermediate state.
Figure 8:
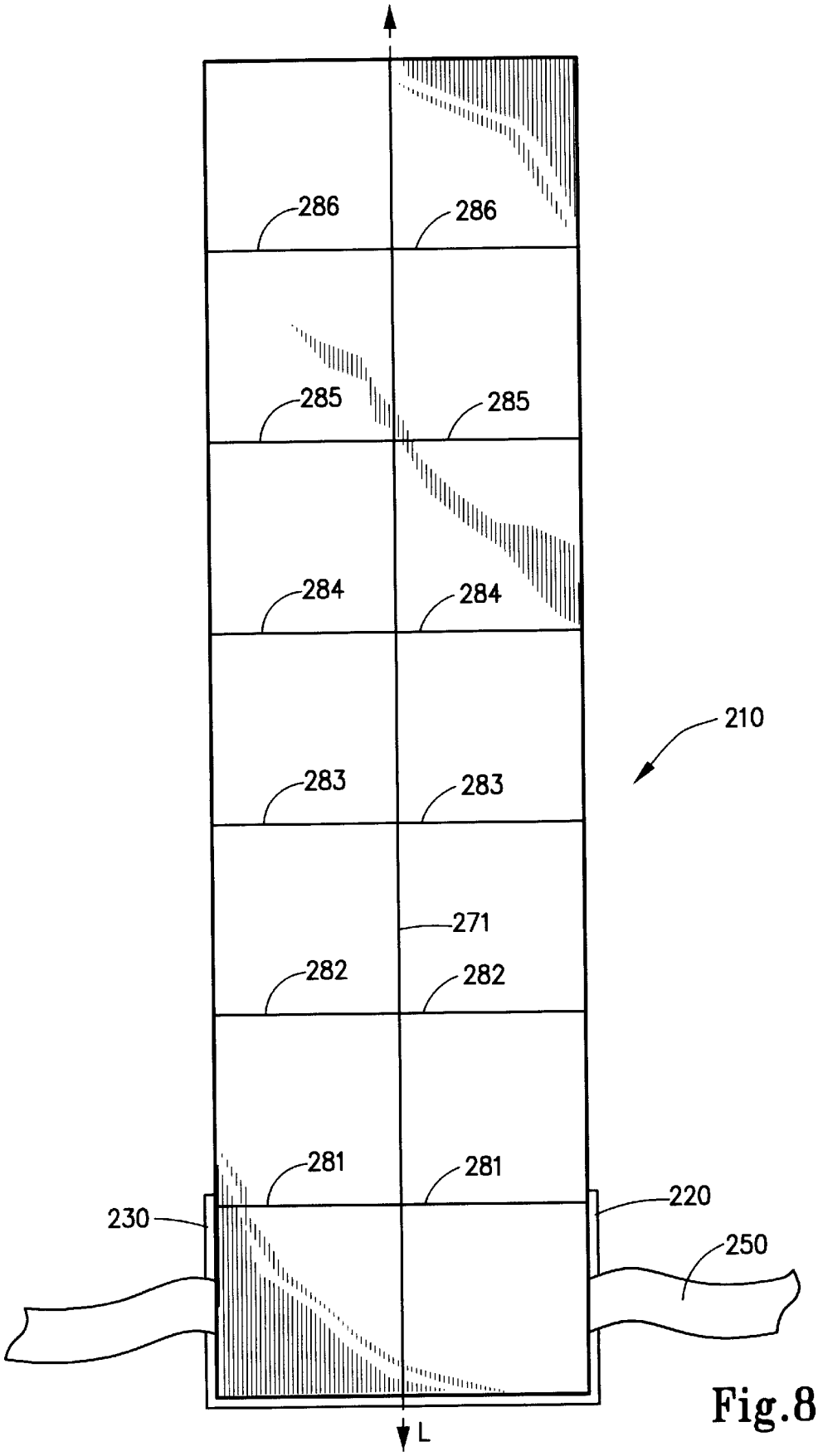
FIG. 8 is a top planer view of the memory album of the second exemplary embodiment of the present invention when in the fully expanded state.

With the foregoing description in mind with reference to the first exemplary embodiment of the memory album 10 of the present invention, a second exemplary embodiment of the memory album may be readily understood with reference to FIGS. 7 and 8. Here, memory album 210 is constructed similarly to memory album 10 such that it has a top cover 220, a bottom cover 230 and a foldable display panel 240 interconnected therebetween. Also included is a fastening member 250 in the form of a ribbon as discussed above. In FIG. 7, memory album 210 has been partially unfolded into an intermediate state, while FIG. 8 shows memory album 210 fully opened up into the expanded state. It may be appreciated that when memory album 210 is in the compact state (not shown) it closely resembles memory album 10 discussed above with reference to the first exemplary embodiment. Accordingly, when in the compact state, the top and bottom covers 220, 230 are positioned in a first orientation whereby they are in a closely spaced-apart facing relationship to one another. However, when in the fully extended state shown in FIG. 8, the top and bottom covers 220, 230 are in a second orientation with respect to one another whereby they are positioned side-by-side.

Further, as may best be seen in FIG. 8, display panel 240 is operative upon movement of memory album 210 into the fully expanded state to unfold about a first fold line 271 which is coextensive with longitudinal axis "L" and a plurality of second fold lines 281–286 which extend transversely to, and preferably perpendicularly to, longitudinal axis "L". Further, longitudinally alternating ones of these second fold lines are reverse folded with respect to one another such that display panel 240 extends in a accordion-like fashion from the compact state to fully expanded state. These fold lines 271 and 281–286 again divide display panel 240 into a plurality of display panel regions adapted to receive the items of memorabilia. The remaining aspects of the construction for memory album 210 according to the second exemplary embodiment of the present invention may be the same as memory album 10 so that they need not be repeated here.

Having described the exemplary embodiments of the memory albums of the present invention, the ordinarily skilled artisan should readily appreciate that various aspects of their construction may be changed without departing from the inventive concepts contained herein. These might include, but not be limited to, the geometric shape of the top and bottom covers, the geometric shape of the various display panel regions and display panel sub-regions, the construction of the fastening member, and the various materials out of which these components are constructed.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

We claim:

1. A memory album adapted for use in retaining and displaying items of memorabilia, comprising:

(a) a top cover;

(b) a bottom cover; and (c) a foldable display panel disposed between said top and bottom covers for receiving said items of memorabilia, said memory album movable between a compact state wherein said display panel is in a collapsed configuration with said top and bottom covers positioned in a first orientation with respect to one another and spaced apart by a minimum first separation distance, and an expanded state wherein said display panel is in a flattened configuration extending along a longitudinal axis with said top and bottom covers positioned at a second orientation with respect to one another that is different than said first orientation and spaced apart by a minimum second separation distance that is greater than the first separation distance, said display panel operative upon movement of said memory album between the compact state and the expanded state to extend along both a first direction that is parallel to a longitudinal axis of said display panel and a second direction that is transverse to said longitudinal axis thereby to reveal a plurality of display panel regions adapted to receivably retain said items of memorabilia, said display panel regions being defined by intersecting fold lines, adjacent ones of which intersect one another only along the longitudinal axis.

2. A memory album according to claim 1 wherein said foldable display panel is interconnected between said top and bottom covers.

3. A memory album according to claim 1 wherein said top and bottoms covers are detached from one another.

4. A memory album according to claim 3 wherein said top and bottom covers are positioned in a close, spaced-apart relationship to one another when said memory album is in said compact state.

5. A memory album according to claim 1 wherein said top and bottom covers are positioned in a close, spaced-apart relationship to one another when said memory album is in said compact state.

6. A memory album according to claim 1 wherein each of said top and bottom covers is constructed of a stiff backing material.

7. A memory album according to claim 6 wherein said backing material is cardboard.

8. A memory album according to claim 1 including a fastening member connected to a selected one of said top and bottom covers, said fastening member operative when placed in a fastened configuration to prevent said memory album from moving from the compact state to the expanded state.

9. A memory album according to claim 8 wherein said fastening member is an elongated and flexible band having a mid-portion bonded to said bottom cover and a pair of opposed free ends adapted to encircle said top cover and tie together, thereby placing said fastening member in the fastened configuration.

10. A memory album according to claim 1 wherein said foldable display panel is constructed to allow a minimum longitudinal separation distance between said top and bottom covers to be varied as said memory album moves between the compact state and the expanded state.

11. A memory album adapted for use in retaining and displaying items of memorabilia, comprising:

(a) a top cover constructed of a stiff backing material;

(b) a bottom cover constructed of a stiff backing material; and (c) an elongated and foldable display panel interconnected between said top and bottom covers for receiving said items of memorabilia, said memory album movable between a compact state wherein said display panel is in a collapsed configuration with said top and bottom covers positioned in a close spaced-apart relationship to one another, and an expanded state wherein said display panel is in a flattened configuration with said top and bottom covers positioned at a separation distance from one another, said display panel operative upon movement of said memory album between the compact state and the expanded state to unfold about a plurality of fold lines that extend transversely to a longitudinal axis of said display panel when said display panel is in the flattened configuration, thereby to reveal a plurality of display panel regions that are adapted to receivably retain said items of memorabilia, said display panel regions being defined, at least in part, by a plurality of vertices, each of which is positioned along the longitudinal axis.

12. A memory album according to claim 11 wherein said fold lines divide said display panel into said display panel regions, there being first ones of said fold lines which extend perpendicularly to the longitudinal axis of said display panel, second ones of said fold lines which extend at a positive acute angle with respect to said longitudinal axis, and third ones of said fold lines which extend at a negative acute angle with respect to said longitudinal axis.

13. A memory album according to claim 12 wherein associated ones of said first, second and third fold lines intersect at a common point along the longitudinal axis.

14. A memory album according to claim 13 wherein each of said second and third fold lines has a common first length and intersects the longitudinal axis at a common said acute angle, and wherein longitudinally adjacent ones of said second and third fold lines share a common endpoint thereby to define a plurality of longitudinally adjacent and geometrically congruent display panel regions sharing a common vertex defined by a respective said common point.

15. A memory album according to claim 14 wherein longitudinally opposed end ones of said display panel regions are secured, respectively, to said top and bottom covers.

16. A memory album according to claim 14 wherein each of said first fold lines has a common second length thereby to define a plurality of transversely spaced-apart and geometrically congruent pairs of said display panel regions.

17. A memory album according to claim 16 wherein each of said transversely spaced-apart pairs of said display panel regions is bisected by an associated one of said first fold lines into geometrically congruent sub-regions.

18. A memory album according to claim 11 wherein said top and bottom covers have a common geometric shape and wherein each of said display panel regions is configured geometrically similar to said top and bottom covers.

19. A memory album according to claim 11 including a fastening member connected to a selected one of said top and bottom covers, said fastening member operative when placed in a fastened configuration to prevent said memory album from moving from the compact state to the expanded state.

20. A memory album according to claim 11 wherein said top and bottom covers are detached from one another.

21. A memory album according to claim 11 wherein adjacent ones of said vertices are separated from one another along the longitudinal axis by a common separation distance.

22. A memory album adapted for use in retaining and displaying items of memorabilia, comprising:

(a) a top cover having a selected geometric configuration;

(b) a bottom cover having said selected geometric configuration;

(c) a foldable display panel interconnected between said top and bottom covers for receiving said items of memorabilia, said memory album movable between a compact state wherein said display panel is in a collapsed configuration with said top and bottom covers positioned in a first orientation with respect to one another, and an expanded state wherein said display panel is in a flattened configuration extending along a longitudinal axis with said top and bottom covers positioned at a second orientation with respect to one another that is different than said first orientation, said display panel operative upon movement of said memory album between the compact state and the expanded state to extend along both a first direction that is parallel to a longitudinal axis of said display panel and a second direction that is transverse to said longitudinal axis thereby to reveal a plurality of display panel regions adapted to receivably retain said items of memorabilia; and d. A flexible fastener connected only to a selected one of said top and bottom covers and operative when placed in a fastened configuration to prevent said memory album from moving from the compact state to the expanded state.

23. A memory album according to claim 22 wherein said top and bottom covers are detached from one another.

24. A memory album according to claim 22 wherein said top and bottom covers have a common geometric shape and wherein each of said display panel regions is configured geometrically similar to said top and bottom covers.

25. A memory album according to claim 24 wherein longitudinally opposed end ones of said display panel regions are secured, respectively, to said top and bottom covers.

26. A memory album according to claim 25 wherein said fastening member is an elongated and flexible band having a mid-portion affixed between said bottom cover and an associated one of the longitudinally opposed end ones of said display panel regions, and a pair of opposite free ends adapted to encircle said top cover when said fastening member is placed in the fastened configuration.

27. A memory album according to claim 22 wherein said fastening member is an elongated and flexible band having a mid-portion affixed to said bottom cover, and a pair of opposite free ends adapted to encircle said top cover when said fastening member is placed in the fastened configuration.

28. A memory album according to claim 22 wherein said top and bottom covers are positioned in a close, spaced-apart relationship to one another when said memory album is in said compact state, and said top and bottom covers are positioned along said longitudinal axis a selected separation distance from one another when said memory album is in said expanded state.

29. A memory album according claim 22 wherein said top and bottom covers are detached from one another.

30. A memory album according to claim 22 wherein said flexible fastener, when in the fastened configuration, spans the display panel at different spaced apart edge margins thereof.

31. A memory album according to claim 30 wherein said flexible fastener, when in the fastened configuration, spans the display panel at opposed spaced apart edge margins.

* * * * *